United States Patent [19]

Gardner

[11] 4,087,068

[45] May 2, 1978

[54] GOLF BAG SUPPORT

[76] Inventor: Leo Max Gardner, 1619-184th NE., Bellevue, Wash. 98008

[21] Appl. No.: 714,175

[22] Filed: Aug. 13, 1976

[51] Int. Cl.[2] ..... A63B 55/00

[52] U.S. Cl. ..... 248/96; 248/359

[58] Field of Search ..... 248/96, 169, 150, 359, 248/136; 150/1.5 B

[56] References Cited

U.S. PATENT DOCUMENTS

| | | | |
|---|---|---|---|
| 1,471,766 | 10/1923 | Wolfe | 248/96 |
| 1,895,454 | 1/1933 | Ducat | 248/96 |
| 2,428,954 | 10/1947 | Apblett et al. | 150/1.5 B X |
| 2,571,088 | 10/1951 | Walton | 248/96 |
| 2,574,194 | 11/1951 | Schlags | 108/29 |
| 2,661,174 | 12/1953 | Sands | 248/96 |
| 2,695,548 | 11/1954 | Silverman | 248/136 X |
| 2,695,761 | 11/1954 | Carpenter et al. | 248/96 |
| 2,749,069 | 6/1956 | Sandstrom | 248/96 |
| 2,846,170 | 8/1958 | Huber | 248/96 |
| 3,123,935 | 3/1964 | Williams | 248/359 X |
| 3,206,149 | 9/1965 | Labe | 248/96 |
| 3,432,130 | 3/1969 | Breedlove et al. | 248/96 |

FOREIGN PATENT DOCUMENTS

| | | | |
|---|---|---|---|
| 427,487 | 4/1935 | United Kingdom | 248/96 |

*Primary Examiner*—Roy D. Frazier
*Assistant Examiner*—Rodney H. Bonck
*Attorney, Agent, or Firm*—Dowrey & Cross

[57] ABSTRACT

A support device for a golf bag comprising a pair of spaced apart legs, rigidly braced with respect to each other, securing means pivotally connecting the legs to the golf bag such that the legs are moveable between an extended position for support of the bag and a retracted position adjacent the bag, and means acting between the legs and the securing means for restraining the legs in their retracted positions.

1 Claim, 5 Drawing Figures

FIG. 5
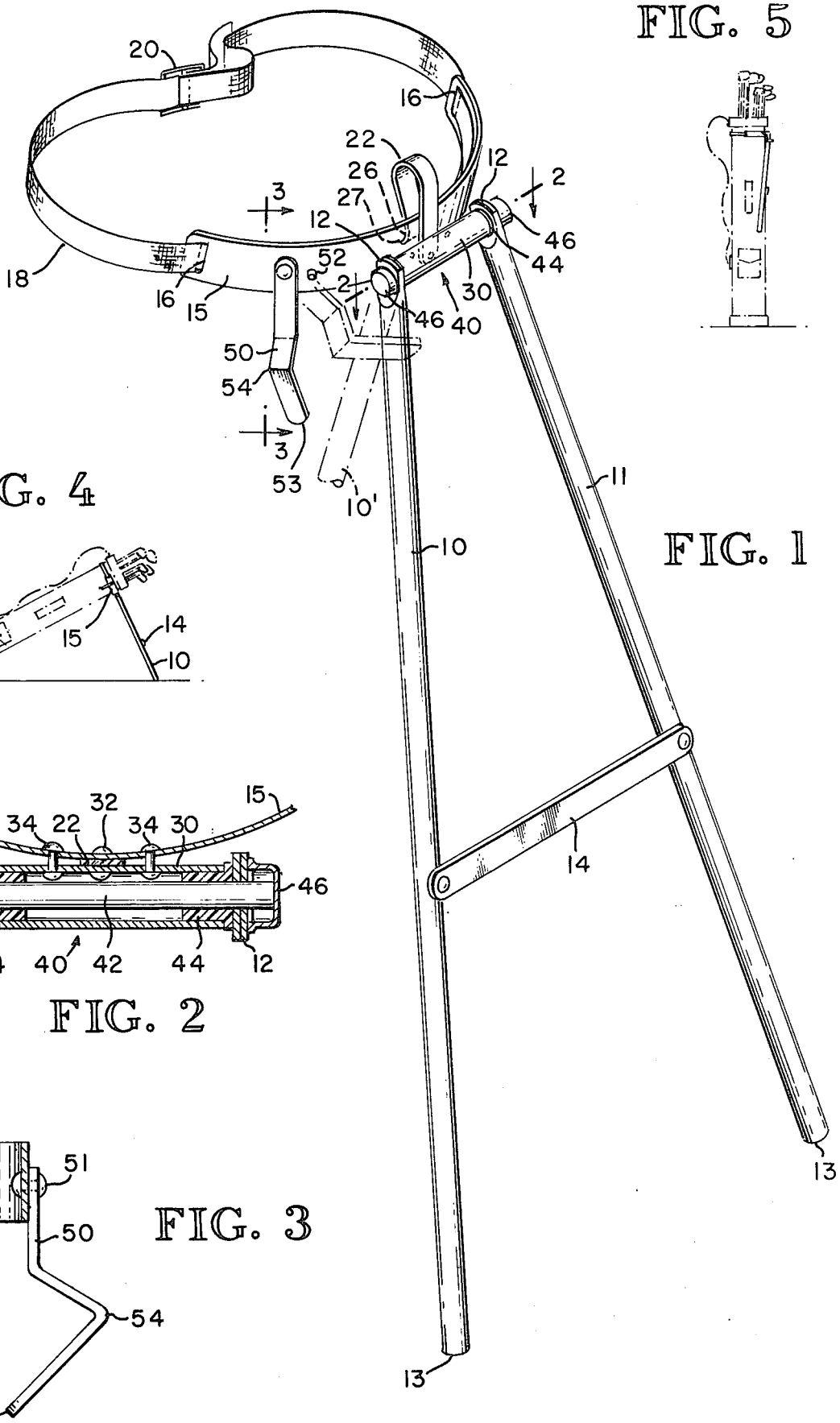
FIG. 1
FIG. 4
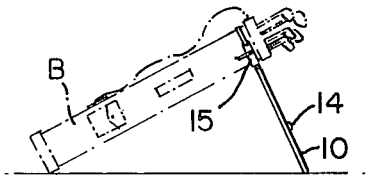
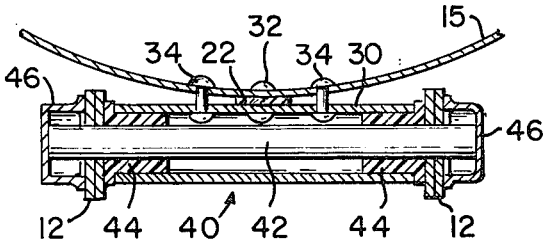
FIG. 2
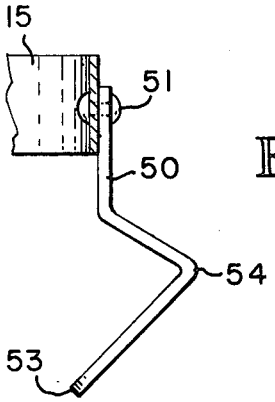
FIG. 3

GOLF BAG SUPPORT

FIELD OF THE INVENTION

This invention relates to golf bag support devices.

BACKGROUND OF THE INVENTION

Prior golf bag support devices typically include a pair of legs which can be positioned alternatively at a retracted position alongside or adjacent the bag, and at an extended position in which they extend away from the bag in a direction generally transverse to the length thereof. The legs when in their extended position provide, in combination with the lower end of the bag, 3-point support for maintaining the bag in a generally upstanding position during club selection, or other appropriate instances. A desirable golf bag support of this type should possess sufficient stability to maintain the bag in its upstanding position, even in wind or on uneven ground; yet should be of such construction that it may be carried about with the bag without overburdening or inconveniencing the golfer while affording selective leg positioning for carrying, storage, transportation, etc.

Prior support devices lack adequate stability, are of excessive weight, are of unnecessary complexity and therefore expensive, or are cumbersome to operate and carry, especially when utilized with light weight canvas or cloth golf bags. The support device disclosed in U.S. Pat. No. 2,324,439, for example, uses a transverse slide to brace and position two flexible legs. Although this device is of relatively light weight, the legs tend to shift or flex relatively when in their extended positions, and the slide is awkward to operate in order to maintain the legs retracted. Prior support devices additionally fail to provide selective positioning or locking of the legs with respect to the bag independently of bag position. The legs making up the support device disclosed in U.S. Pat. No. 1,693,889, for example, are automatically retracted by the force applied by the bag shoulder strap when the bag is lifted thereby. Likewise, the legs which make up the support disclosed in U.S. Pat. No. 3,195,844, are retracted by a spring-powered retraction assembly when the bag is lifted. Additional prior support devices are disclosed in U.S. Pat. Nos. 1,471,766, 2,768,668 and 2,283,412.

SUMMARY OF THE INVENTION

This invention provides a golf bag support device which affords stable 3-point support for a golf bag, even under adverse conditions, together with selective positioning of the support in a retracted position for carrying, storage, transportation, etc.

According to one preferred embodiment of the invention, the support includes two spaced apart legs which are rigidly braced with respect to each other, and securable to a golf bag such that the legs can be moved between a position in which they extend away from the golf bag in a generally transverse direction, to provide 3-point support therefore, and a retracted position alongside the golf bag and generally parallel to the length thereof. Means independent of golf bag position selectively restrain the legs in their retracted position. While preferably the restraining means are constituted by a member located adjacent the pivoted ends of the legs, (and adjacent the upper end of the bag with the support secured thereto) for easy access by a person carrying the bag, the restraining means may be constitued by other means.

These and other features, objects and advantages of this invention will become apparent in the detailed description and claims to follow taken in conjunction with the accompanying drawings in which like parts bear like reference numerals in the various views.

BRIEF DESCRIPTION OF THE DRAWINGS

FIG. 1 is a perspective view of a golf bag support device according to the present invention;

FIG. 2 is a section taken along the line 2—2 in FIG. 1;

FIG. 3 is a section taken along the line 3—3 in FIG. 1;

FIG. 4 is a side elevational view of a golf bag supported by the FIG. 1 support device with legs extended;

FIG. 5 is a side elevational view generally similar to FIG. 4 of the FIG. 1 support device with legs retracted and locked.

DETAILED DESCRIPTION OF THE DRAWINGS

Referring to FIG. 1, the golf bag support device is comprised of a pair of spaced apart legs 10 and 11 in fixed relative positions. Arcuate collar 15, strap 18 and clip 22 attach the support device to a golf bag. Connecting means (designed generally by reference numeral 40) pivotally connect the legs 10 and 11 with collar 15 so that the legs can swing by gravity, or can be swung manually, between an extened position (FIG. 4) and a retracted position (FIG. 5). Refer also to the partially extended and retracted leg positions depicted in solid and broken lines (10 and 10') in FIG. 1, respectively. Restraining member 50, acting between collar 15 and leg 10 selectively restrains the legs in their retracted position, independently of bag position, as will be described presently.

Still referring to FIG. 1, legs 10 and 11 are elongated members having flattened upper end portions 12 and cylindrical lower end portion 13. They preferably are constructed of light weight rigid material, such as tubular aluminum. As illustrated in FIG. 1, the legs diverge with respect to one another from the point of connection of their ends 12 with means 40, although legs 10 and 11 could be parallel, if desired. The illustrated divergent leg construction is preferred, however, because it affords added stability against transverse forces. Transverse brace 14 connects the legs intermediate the lengths thereof. Brace 14 is so positioned and secured to the legs that it holds them in fixed coplanar relation with respect to one another in order to provide a combined rigid and light weight leg assembly. Preferably brace 14 is connected to the legs at a point closer to their ends 13 than to ends 12. The legs further are of appropriate lengths that, when swung to their extended position (FIG. 4), the golf bag B is positively supported and maintained in an upstanding position, with its open end facing up for club selection, even on uneven ground or in high winds. Although FIG. 4 illustrates the legs in their extended positions as being perpendicular to the length of the golf bag, they may assume extended positions at other angles to the length of the bag, depending on the length of the legs and the point of attachment of the device to the bag.

Collar 15 and strap 18 attach the support device to the golf bag. Collar 15 is an elongated arcuate member having openings 16 near its ends. As shown in FIG. 1, strap 18 is threaded through these openings and the free ends of the strap are selectively and adjustably connected via buckle 20. The strap is of sufficient length that it may be passed around the circumference of the golf bag and drawn tight via buckle 20, thereby securing the support device to the golf bag as indicated in FIG. 4.

To further secure the support device to the golf bag, clip 22 may be provided for engaging the lip of the bag. The clip is a generally inverted U-shaped member of flexible material and, as illustrated in FIGS. 1 and 2, is secured at one end between collar 15 and tubular spacer 30 by rivet 32. Its other end 26 (see FIG. 1) is free, and is so positioned adjacent the inner surface of collar 15 and the overlying portion of the strap 18 that the lip of the bag may be engaged between and held by the collar and the free end 26 of the clip. Free end 26 has an upturned portion 27 to facilitate entry of the golf bag between the clip and the collar. The clip additionally serves to determine the point of attachment of the support device to the upper end of the golf bag and, to this end, is of appropriate length from end 26 to its curved midsection. It will be recognized that other attachment means may be used in place of or in combination with collar 15, strap 18 or clip 22.

Referring now in particular to the connecting means of FIGS. 1 and 2, a rod 42 passes through circular openings in leg ends 12 and is positioned in co-axial relationship with spacer 30 by opposed tubular collars 44. End caps 46 are secured to the ends of rod 42 and maintain ends 12, collars 44 and spacer 30 in the illustrated coaxial contact positions, while permitting rotational movement of legs 10 and 11 about the longitudinal axis of rod 42 with sufficient low friction that the legs can swing by gravity between their extended and retracted positions. Spacer 30 is fastened to collar 15 by rivets 34, as shown (FIG. 2). Rotational movement of the legs may be stopped by means not shown at a suitable position in order to positively position them at their extended position.

Referring now to FIGS. 1 and 3, the restraining means of this invention comprises an elongated restraining member 50 which is pivotally mounted by rivet 51 from collar 15 and can be swung selectively in a plane generally parallel to the adjacent face of collar 15. Preferably, sufficient frictional force is applied to member 50 that it will not pivot under its own weight. As shown in FIGS. 1 and 3, member 50 is of such a shape that, when swung to an extended position, shown in broken lines in FIG. 1, its distal end (referenced by numeral 53) engages and maintains leg 10 retracted. In its retracted position (shown in solid lines in FIG. 1), member 50 averts from the path of movement of leg 10 and therefore does not inhibit movement thereof.

In the embodiment illustrated in the drawings, member 50 is provided with an intermediate angle portion 54 (FIG. 3) which may conveniently be engaged by the hand even when the bag is being carried over the shoulder. Thus after taking a shot and replacing the club, the golfer merely hoists the bag onto his shoulder, whereupon the legs hang downward in generally perpendicular relation with the bag. The legs are retracted and locked by reaching under the bag, manually swinging them into their FIG. 5 position, and then swinging member 50 into its FIG. 1 locking position (depicted in broken lines). To prevent member 50 from moving past its optimum restraining position, outwardly projecting pin 52 (FIG. 1) may be provided at an appropriate location on collar 15. When the next shot is reached, of course, the golfer swings member 50 back to its non-restraining position, whereupon the legs can swing by gravity to their extended FIG. 4 position for supporting the bag. As will now be appreciated, member 50 is selectively operative independently of bag position and further may be used to maintain the legs retracted when the bag is positioned vertically for storage, or on its side for transportation, etc. Member 50 thus constitutes highly effective leg restraining means.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. A support device for a golf bag, comprising:

two legs, each leg having first and second ends;

means for connecting said legs intermediate their first and second ends, and maintaining said legs in fixed coplanar divergent relation from their first ends;

attachment means including a collar for attaching the support device to a golf bag;

connecting means including a pivot mounted by said collar for pivotally connecting said legs at their first ends to said attachment means such that said legs may swing about said pivot between an extended position for support of the bag and a retracted position adjacent the bag, said pivot being of sufficiently low friction that said legs may be swung freely between their advanced and retracted positions by at least a gravitational force; and restraining means acting between said collar and said legs for restraining said legs in their retracted position, said restraining means comprising an elongated member having first and second ends and an intervening portion, said elongated member being pivotally connected adjacent its first end to the collar at a location spaced from said pivot for movement to and from a restraining position in which its second end engages one of said legs only when said legs are in their retracted position, and said intervening portion including a portion which projects outwardly from the golf bag between said first and second ends a distance sufficient that it may be engaged in order to swing said elongated member to and from its restraining position independently of the bag and said legs.

* * * * *